US005919390A

United States Patent [19]

Childress

[11] Patent Number: 5,919,390

[45] Date of Patent: Jul. 6, 1999

[54] METHOD AND PACKAGE FOR MICROWAVE ROASTING OF UNSHELLED PEANUTS/NUTS/SEEDS

[76] Inventor: Rickey T. Childress, 21120 County Rd. 13, Fairhope, Ala. 36532

[21] Appl. No.: 08/978,778

[22] Filed: Nov. 26, 1997

[51] Int. Cl.[6] ..... H05B 6/80; B65D 81/34

[52] U.S. Cl. ..... 219/725; 219/727; 99/DIG. 14; 426/107; 426/234; 426/241

[58] Field of Search ..... 219/725, 727, 219/732, 734; 99/DIG. 14; 426/107, 109, 241, 243, 234

[56] References Cited

U.S. PATENT DOCUMENTS

| | | | |
|---|---|---|---|
| 4,190,757 | 2/1980 | Turpin et al. . | |
| 4,204,105 | 5/1980 | Leveckis et al. . | |
| 4,267,420 | 5/1981 | Brastad . | |
| 4,477,705 | 10/1984 | Danley et al. . | |
| 4,571,337 | 2/1986 | Cage et al. . | |
| 4,590,349 | 5/1986 | Brown et al. . | |
| 4,691,374 | 9/1987 | Watkins et al. . | |
| 4,982,064 | 1/1991 | Hartman et al. | 219/727 |
| 5,008,024 | 4/1991 | Watkins . | |
| 5,011,299 | 4/1991 | Black, Jr. et al. | 219/727 |
| 5,044,777 | 9/1991 | Watkins et al. . | |
| 5,097,107 | 3/1992 | Watkins et al. . | |
| 5,230,160 | 7/1993 | Gross et al. | 34/263 |
| 5,241,149 | 8/1993 | Watanabe et al. . | |
| 5,317,120 | 5/1994 | Bunke et al. | 219/730 |
| 5,344,661 | 9/1994 | Mendenhall et al. . | |
| 5,352,465 | 10/1994 | Gondek et al. . | |

*Primary Examiner*—Philip H. Leung
*Attorney, Agent, or Firm*—Lanier Ford Shaver & Payne, P.C.; Frank M. Caprio; Russell L. Sandidge

[57] ABSTRACT

A package is described comprising a bag with at least two layers, an outer layer comprised of kraft paper and an inner layer comprised of a thinly extruded polymeric material. The bag is at least partially filled with raw, unshelled nuts or seeds for roasting. The product is roasted by placing the bag in a microwave oven and cooking for a predetermined time limit to achieve the desired texture and crunchiness of the roasted product, and then allowing the food contents to cool thereby improving the crunchiness of the roasted product.

24 Claims, 3 Drawing Sheets

METHOD AND PACKAGE FOR MICROWAVE ROASTING OF UNSHELLED PEANUTS/NUTS/SEEDS

FIELD OF THE INVENTION

The present invention relates to microwavable food packages, and more particularly to packages suitable for roasting peanuts and other nuts or seeds in a microwave oven, and a method for using same.

BACKGROUND OF THE INVENTION

Cooking articles with microwave energy has now become commonplace. A wide variety of packages have been proposed to utilize microwave energy to heat and cook various foods. For example, U.S. Pat. Nos. 5,097,107, 5,008,024, 5,044,777, and 4,571,337, as well as numerous other U.S. patents, all relate to packaging for microwavable popcorn. The packages described in these patents purportedly provide means for evenly distributing microwave heat so that a large percentage of kernels are popped and few of the popped kernels are overcooked. The patents relate other advantages of the packages, such as ease of handling, proper expansion as kernels are popped, and cooling advantages. Many microwavable popcorn containers are comprised of bags made of kraft paper and possibly a polymeric inner layer. Kraft paper has been found to be a suitable material for utilizing microwave energy to cook food.

Other patents exist relating to microwave packages that assist in transferring microwave heat into thermal heat, which helps brown and evenly cook foods, such as U.S. Pat. No. 4,267,420. It is widely recognized that the molecular friction resulting from the high frequency oscillation of microwave ovens fails to impart the proper amount of crispness to foods normally expected to possess such a quality. Consequently, when such foods are heated in a microwave oven, they do not possess the requisite degree of eye appeal and taste appeal that one normally expects. Various attempts have been made to correct for the inherent lack of browning or crispening when employing microwave heating, primarily aimed toward modifying the microwave oven or using edible coatings on the food itself, but also directed towards specific packaging requirements for various foods.

Heretofore, no patent has addressed a suitable package for roasting unshelled peanuts or other nuts or seeds in a microwave oven in a manner that will produce an appealing texture and crunchiness. Microwave roasting in-shell nuts and seeds presents a unique challenge because the microwave heat must be utilized precisely to achieve the desired texture and crunchiness of the roasted product. To this end, a package which at least partially converts microwave heat into thermal heat is desirable. In addition, nuts or seeds that are tightly packed together tend to roast unevenly in a microwave, so a suitable microwave package should allow enough room for proper roasting, while still providing adequate amounts of product for consumption.

Microwave peanut roasting is a desirable objective, since the conventional method of roasting peanuts is extremely time consuming and requires a large amount of advanced planning and experience. Furthermore, the ability to roast raw peanuts is more desirable than purchasing currently available pre-roasted peanuts, because the raw peanuts have a much longer shelf life and taste fresher when roasted at home in a microwave as opposed to pre-roasted peanuts. Peanuts are a popular and nutritious food item that many people would roast on a regular basis if a convenient roasting method existed. In addition, many people enjoy other roasted nuts such as pecans or chestnuts, as well as roasted sunflower or pumpkin seeds. The use of microwave ovens to prepare food has become so commonplace that any new microwavable food will be readily useful in the marketplace.

Thus, there is a need for a package and method for roasting peanuts and other nuts or seeds in a microwave oven. A major objective of the present invention is to provide a microwave package for roasting raw, unshelled nuts or seeds which requires no manipulation prior to use and which provides for even distribution of microwave heat and results in a roasted product of desirable texture and crunchiness. Another objective is providing a microwave package for roasting nuts or seeds that contains a controlled portion of product in a convenient size for storage and handling, and an easy roasting method. These and other more detailed and specific objects of the present invention will be apparent in view of the following description setting forth various forms of the invention.

SUMMARY OF THE INVENTION

One embodiment of this invention provides a package for roasting leguminous nuts or seeds in a microwave oven comprised of a bag having at least two layers, an inner and outer layer, wherein the outer layer comprises kraft paper, and the inner layer comprises a polymer suitable for microwave roasting of such nuts or seeds. Raw, unshelled nuts or seeds are placed inside the bag. In a preferred embodiment the polymer is a polyester and the kraft paper is 25 lb. bleached natural kraft paper. The polymer layer may also be coated with a heat seal coating and the bag may be sealed shut at both ends using an adhesive. In the most preferred embodiment the nuts are peanuts.

In another embodiment of this invention, a bag having an outer layer comprising kraft paper, and an inner layer comprising a polymer suitable for microwave roasting, is filled with raw, unshelled nuts or seeds in an amount equal to about 30% to 45% of the interior volume of the bag, and in another embodiment equal to about 33% to about 38%. The nuts are preferably peanuts, and more preferably Valencia or Virginia type, raw, unshelled peanuts. The nuts or seeds may be salted, or, in yet another embodiment the peanuts or other nuts or seeds may be mixed with other spices or flavoring components to impart a desired flavor to the end product.

In still another embodiment of the invention, a hole is formed in the kraft paper exterior layer of the microwavable bag, exposing a portion of the interior thinly-extruded, polymeric film layer, and thereby forming a window through which the product may be viewed without opening the bag.

Another embodiment of this invention comprises a method for roasting leguminous nuts or seeds in a microwave oven. The method includes providing a bag containing raw, unshelled nuts or seeds, said bag having an outer layer comprised of kraft paper, and an inner layer comprised of a polymer suitable for microwave roasting, placing the bag containing the product into a microwave oven, cooking the bag for a sufficient time for the product to obtain a desired texture, and allowing the bag to cool so that the product may be safely handled, and so that the product obtains the desired texture and crunchiness. In a preferred embodiment the leguminous nuts are peanuts.

DESCRIPTION OF THE PREFERRED EMBODIMENTS

Figure 3:
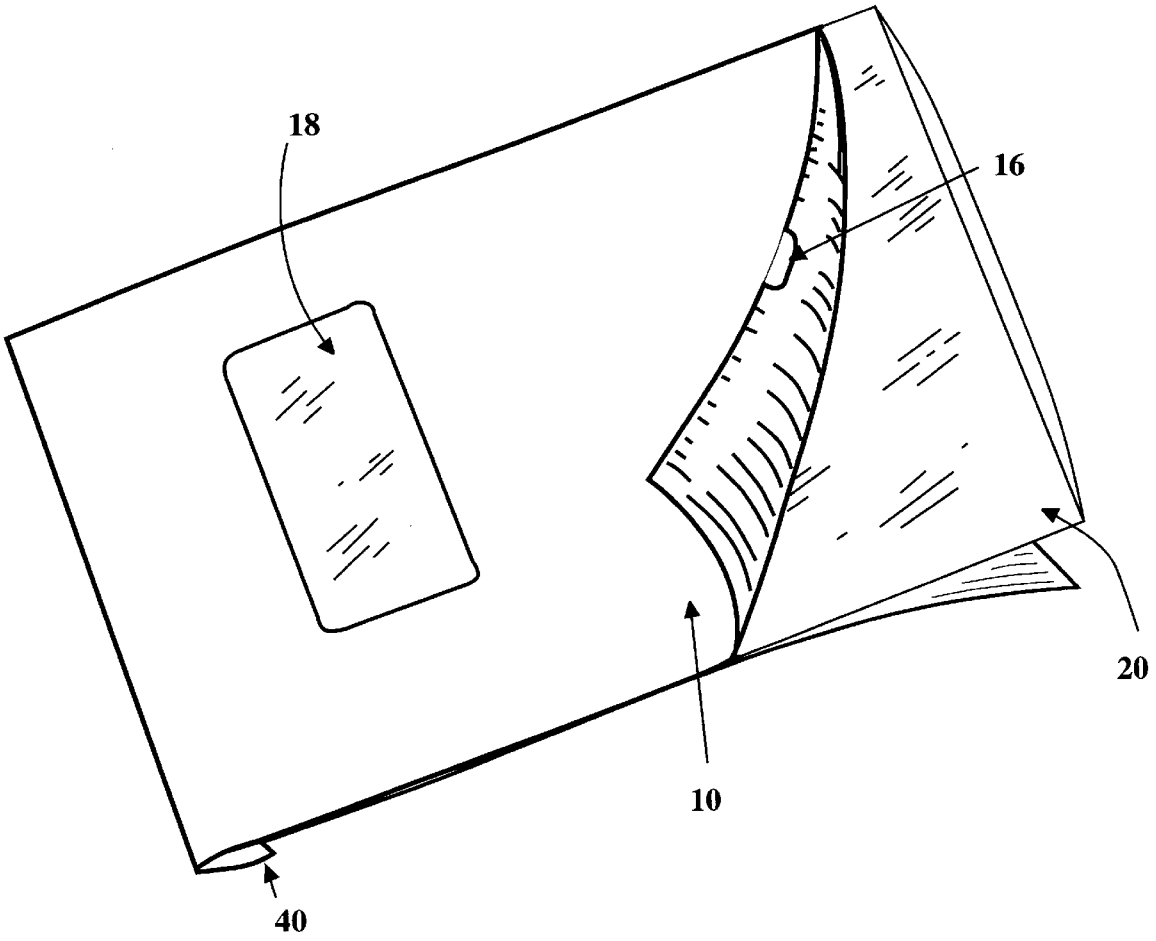
FIG. 3 is a cutaway view of a microwavable package prepared according to the present invention revealing the two layers of the bag.

As shown in FIG. 3, the microwave roasting package of the present invention comprises a bag made of at least two layers: an outer layer 10 prepared from a suitable paper product with an inner layer 20 comprised of a thinly extruded thermoplastic polymer. The bag is at least partially filled with raw, unshelled nuts or seeds for roasting. The exterior layer 10 of the bag is a paper product that can be generally described as kraft paper, and preferably consists of a single layer of kraft paper that may be treated with a stain inhibitor. In the preferred embodiment, the outer layer is comprised of 25 lb. bleached natural kraft paper such as may be purchased from the AB Fowler Speciality division, and other common paper sources. The inner polymeric layer 20 is preferably a polyester film such as polyethylene terephthalate. Alternative inner layer materials consist of other polymers that may be thinly extruded and possibly multiple layers of various polymeric material. The preferred thickness of the inner layer 20 is about 80 gauge, and the polymeric material selected should be capable of withstanding temperatures of about 350° to 450° F., as will typically be encountered in a microwave oven, without melting or otherwise contaminating or imparting flavor to the food ingredients. The polymeric layer 20 is preferably extruded into a thin, transparent film. A coating sensitive to a combination of heat and pressure, commonly referred to as a heat seal coating, may be applied to the interior surface of the polymeric film 20.

Figure 1:
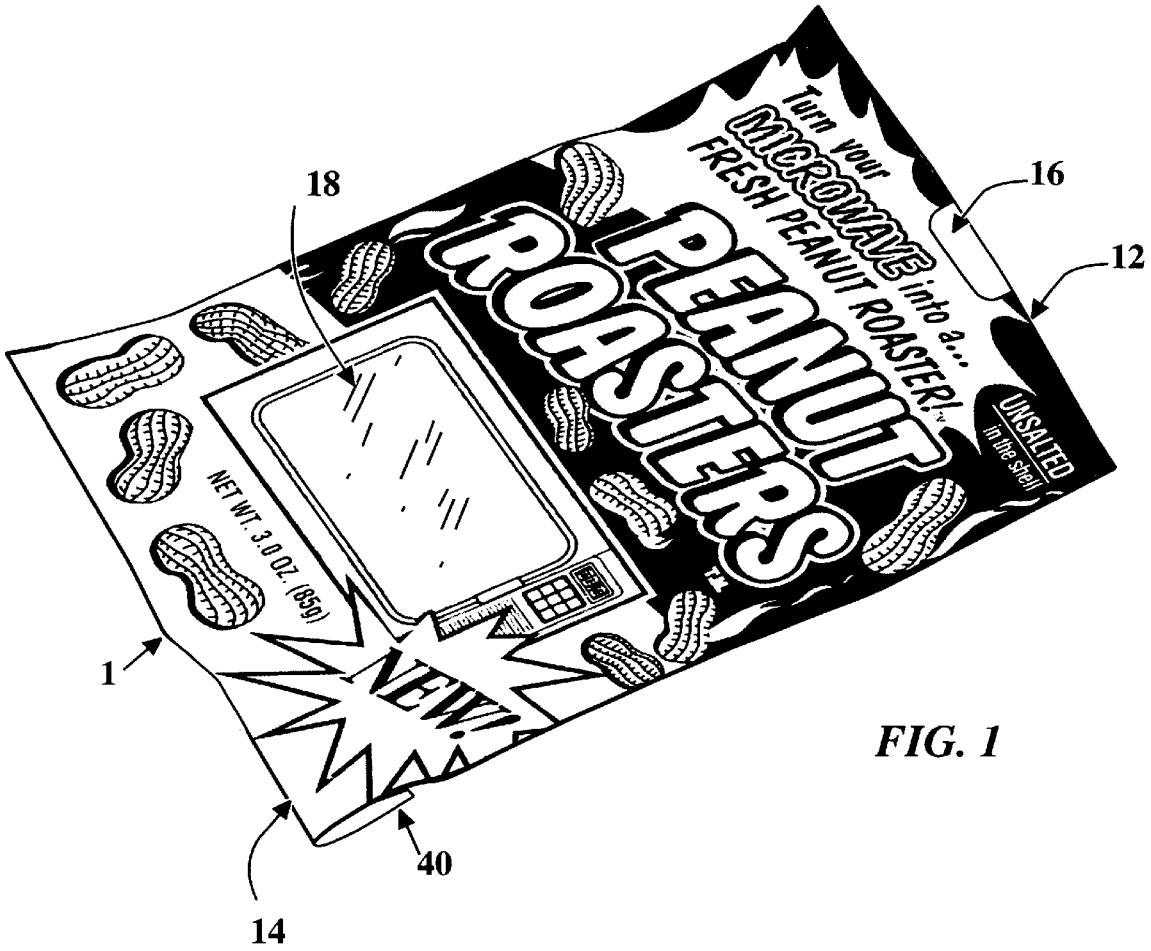
FIG. 1 is a view of a microwavable package which is a preferred embodiment of the present invention.
Figure 4:
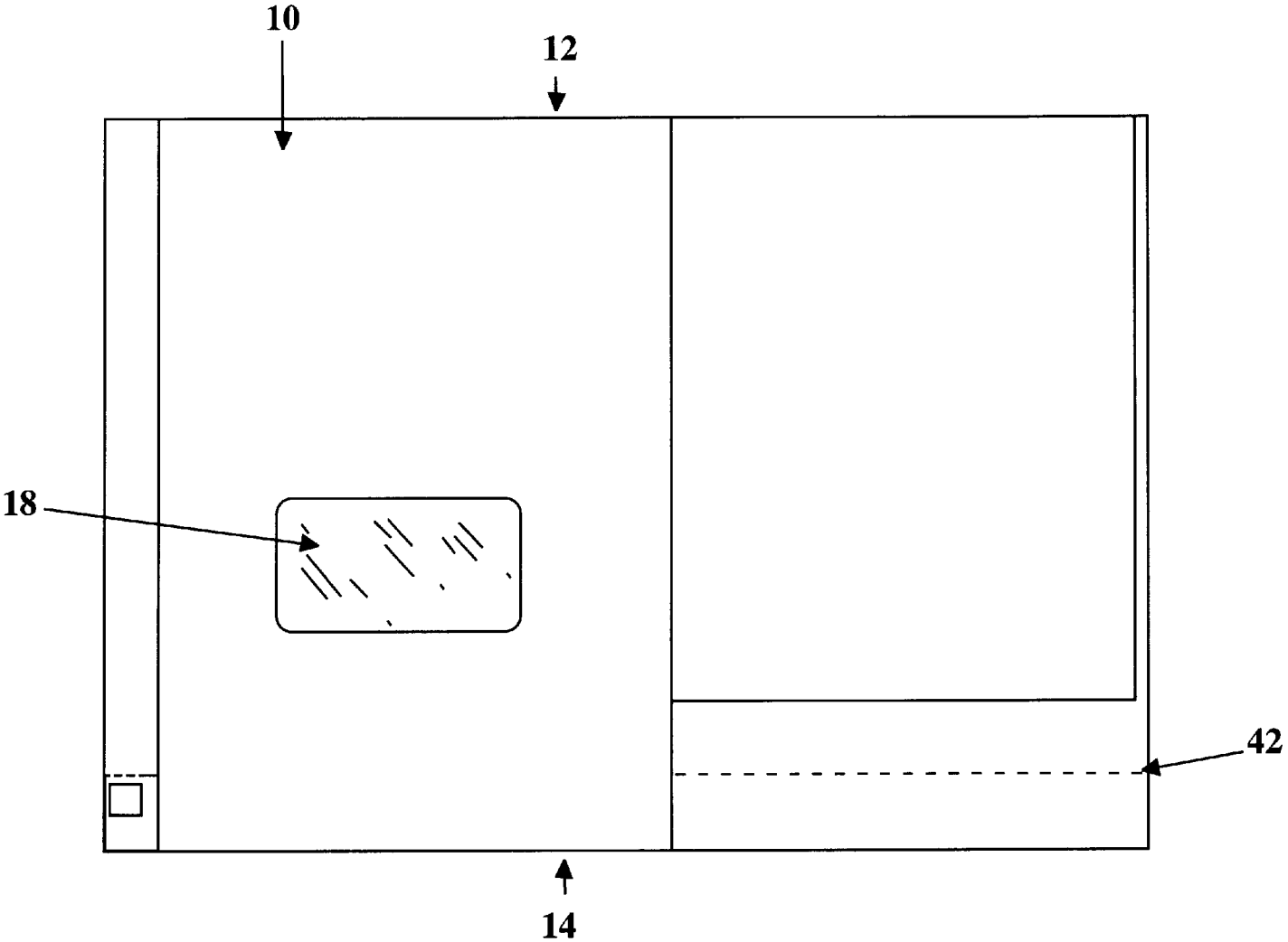
FIG. 4 is a view of the outer paper layer of a microwavable package prepared according to one embodiment of the present invention, demonstrating the fold lines.

The bag may be sealed at both ends 12, 14 using any type of suitable thermoplastic adhesive, which can be applied using any commercially available adhesive applying equipment. As shown in FIG. 1, the bottom edge of the bag 14 is preferably sealed by a fold 40 to avoid accidental opening. The fold line 42 is shown in FIG. 4. The fold 40 is held in place by an adhesive which forms a paper-to-paper seal in addition to the interior thermoplastic seal. The top portion of the bag 12 should be sealed together with a commercially available adhesive that may be easily opened by the consumer after roasting. One suitable adhesive is an industrial standard food grade adhesive which may be obtained, for example, from AB Fowler Co. under the trade name NaBond. Other adhesives such as dextrine or starch based adhesive may be used if desired. The top portion 12 of the kraft paper layer 10 may also include a small thumb notch 16 to assist in the packaging process. The peelable seal along the top edge of the bag is an easily separated film-to-film seam, this being the result of the manner in which the heat seal coating is applied and processed. In addition, there is no folded paper-to-paper seam along the top edge, which allows for easier opening by the consumer.

If the polymeric layer 20 is a thinly extruded, transparent film, then the outer paper liner 10 may optionally have a hole cut 18 in it to reveal the polymeric layer 20, thus producing a window through which the product may be viewed. This allows the user to observe the roasting product while determining if the roasting time has been sufficient. The window opening is not required to achieve the desired roasting, but is a beneficial option.

In the preferred embodiment, the package is folded such that the interior volume is approximately 22 fluid ozs., the window 18 is about 1½ inches×2½ inches and the thumb notch 16 is about ¼ inch×1 inch.

Figure 2:
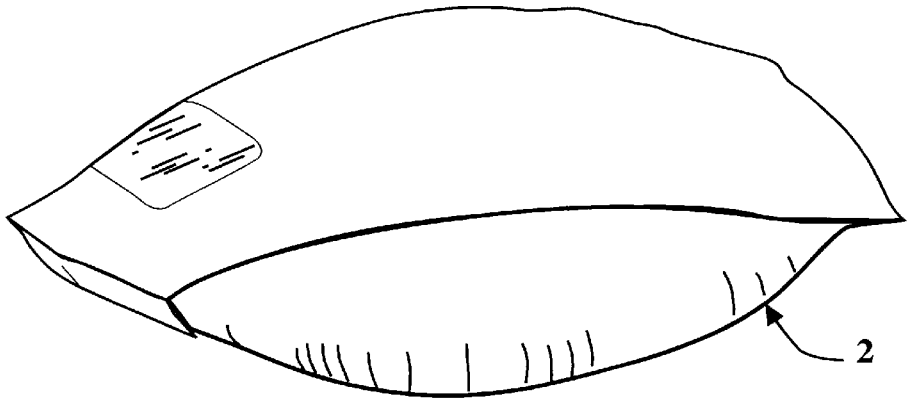
FIG. 2 is a view of a package prepared according to the present invention during cooking.

The above-described package composition has been found to provide the optimum texture, crunchiness, and flavor for roasting nuts or seeds in a microwave oven. Although the leguminous product could be roasted in a plain paper sack, open dish, or conceivably any other microwavable container, the bag composition of the present invention allows the product to be thoroughly and evenly cooked while avoiding overcooking or burning, and allows the product to retain a pleasant flavor. The kraft paper outer layer 10 also acts as an insulator, trapping heat on the inside of the package and allowing for easier handling while the contents of the package is still hot. Further, the bag composition described herein allows for a certain amount of the microwave heat to be transformed into thermal heat within the bag which assists in providing a more flavorful product with the desired texture. FIG. 2 shows the microwave package during cooking. The swollen appearance of the package demonstrates that the package is holding heat and steam generated during microwave cooking which helps impart the desired texture and flavor to the product.

The paper/polymer bag is at least partially filled with raw, unshelled nuts or seeds suitable for roasting. The ingredients are placed inside the bag in such a manner that they are evenly spread around the internal surface area of the package. The ingredients consist principally of raw, unshelled nuts or seeds, however, salt or other flavoring materials may be added to enhance the aromatic quality of the end product. When roasting peanuts, it has been found that about 200 mg. of salt per 3.0 oz. of peanuts provides a desirable taste, but this amount may be adjusted to suit user preference. Preferably, the nuts or seeds are all of approximately equal size so that substantially all of the product will roast uniformly within a relatively narrow time frame. The preferred peanuts for use with the present invention are Valencia or Virginia peanuts, but any raw, unshelled peanuts may be used. With other nuts or seeds, some experimentation may be necessary to determine the optimum type of nut or seed that provides a substantially uniform size and shape that is amenable to microwave roasting.

Another important consideration in the packaging of microwavable nuts or seeds is the ratio of product-to-air in the bag. I have discovered that placing too many nuts or seeds in a container so that they are tightly packed together will result in uneven cooking, so that much of the product will fail to achieve the desired texture or crunchiness. Care should be taken that enough air remains in the container so that the heat can be transferred among the nuts or seeds evenly. When microwave roasting peanuts, a volumetric ratio from about 30% to 45% peanuts in the bag has been found to be sufficient to provide even cooking, and more preferably from about 33% to 38% peanuts in the bag. By way of example, 3.0 ounces of Valencia or Virginia peanuts may be placed into a 22 fluid ounce bag to provide optimum microwave cooking and also a good volume of peanuts for consumption.

The leguminous nuts or seeds are roasted by placing them in a standard microwave oven and cooking until a desired texture is obtained. Some experimentation may be required to determine the optimum cooking times and heating levels based upon the materials used to construct the microwavable bag and the particular microwave oven used. It has been found that interrupting the cooking process in the middle, to flip the package, may improve the evenness of cooking. Using the preferred embodiment package, it has been found that optimum microwave cooking times for peanuts range from about 2.5 minutes to about 3.0 minutes at medium cooking levels, depending upon the microwave oven used and the desired texture of the peanuts. The optimum cooking times for other nuts or seeds may vary, but minimal experimentation will reveal the preferred roasting times. Once the nuts or seeds have been exposed to the microwave energy for the desired time period, the bag should be removed from the microwave oven and allowed to cool without opening. This cooling period provides for continued thermal heating of the product and has been found to substantially affect the crunchiness of the product upon consumption. The nuts or seeds should be allowed to cool at least until they may be safely touched with bare hands. It has been found that longer cooling periods may increase the crunchiness of the peanuts.

As will be appreciated from the above description, the present invention provides a convenient and easy to use raw, unshelled ingredient and container combination suitable for use in microwave ovens. While a particular form of the invention has been illustrated and described, it will be apparent that various modifications can be made without departing from the spirit and the scope of the invention. Accordingly, it is not intended that the invention be limited except as by the appended claims.

I claim:

1. A package for roasting unshelled nuts or seeds in a microwave oven comprising:

a) a bag having an inner and outer layer, said outer layer comprising kraft paper and said inner layer comprising a polymer suitable for microwave cooking; and b) a raw, unshelled food product comprising nuts or seeds having shells placed within the bag;

wherein the bag is sealed shut for microwave cooking such that sufficient steam is trapped within the bag during microwave cooking to assist in providing a desired texture to the food product.

2. The package of claim 1 wherein the polymer is polyester.

3. The package of claim 2 wherein the polyester is coated with a heat seal coating.

4. The package of claim 2 wherein the kraft paper is 25 lb. bleached natural kraft paper.

5. The package of claim 2 wherein the bag is sealed shut for microwave cooking, using a thermoplastic adhesive.

6. The package of claim 2 wherein a hole is formed in the kraft paper exposing a portion of the polymer layer thereby forming a window through which the food product may be viewed without opening the bag.

7. The package of claim 1 wherein the food product consists of peanuts.

8. The package of claim 7 wherein the volume of peanuts is equal to 30% to 45% of the interior volume of the bag.

9. The package of claim 8 wherein the peanuts are salted.

10. The package of claim 1 wherein spices or other flavoring components are mixed with the food product to impart flavor to the food product during roasting.

11. The package of claim 1, wherein the food product consists of seeds.

12. The package of claim 11 wherein the volume of seeds is equal to 30% to 45% of the interior volume of the bag.

13. A method for roasting nuts or seeds in a microwave oven comprising:

a) providing a bag containing a raw, unshelled food product comprising nuts or seeds having shells, said bag having inner and outer layers, said outer layer comprising kraft paper and said inner layer comprising a polymer suitable for microwave roasting;

b) placing the bag containing said food product into a microwave oven;

c) cooking the bag for a time sufficient for the food product to obtain a desired texture; and d) allowing the bag to cool so that the food product may be safely handled.

14. The method of claim 13 wherein the polymer is polyester.

15. The method of claim 14 wherein the polyester is coated with a heat seal coating.

16. The method of claim 14 wherein the kraft paper is 25 lb. bleached natural kraft paper.

17. The method of claim 14 wherein the bag is sealed shut for microwave cooking, using a thermoplastic adhesive.

18. The method of claim 14 wherein a hole is formed in the kraft paper exposing a portion of the polymer layer thereby forming a window through which the food product may be viewed without opening the bag.

19. The method of claim 13 wherein the food product consists of peanuts.

20. The method of claim 19 wherein the volume of peanuts is equal to 30% to 45% of the interior volume of the bag.

21. The method of claim 19 wherein the peanuts are salted.

22. The method of claim 13 wherein spices or other flavoring components are mixed with the food product to impart flavor to the food product during roasting.

23. The method of claim 13 wherein the food product consists of seeds.

24. The method of claim 23 wherein the volume of seeds is equal to 30% to 45% of the interior volume of the bag.

* * * * *